US009470375B2

(12) United States Patent
Van Es

(10) Patent No.: US 9,470,375 B2
(45) Date of Patent: Oct. 18, 2016

(54) LED BASED LINE ILLUMINATION LUMINAIRE AND SYSTEM

(71) Applicant: KONINKLIJKE PHILIPS N.V., Eindhoven (NL)

(72) Inventor: Arthur Robert Van Es, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/429,839

(22) PCT Filed: Sep. 10, 2013

(86) PCT No.: PCT/IB2013/058416

§ 371 (c)(1),
(2) Date: Mar. 20, 2015

(87) PCT Pub. No.: WO2014/045164

PCT Pub. Date: Mar. 27, 2014

(65) Prior Publication Data

US 2015/0233533 A1 Aug. 20, 2015

Related U.S. Application Data

(60) Provisional application No. 61/704,091, filed on Sep. 21, 2012.

(51) Int. Cl.
*H01J 5/48* (2006.01)
*F21K 99/00* (2016.01)
(Continued)

(52) U.S. Cl.
CPC ..... *F21K 9/175* (2013.01); *F21S 4/008* (2013.01); *F21S 8/043* (2013.01)

(58) Field of Classification Search
CPC ..... F21K 9/175; F21S 4/008; F21S 8/043; F27S 4/00; F21V 21/03; F21V 21/05
USPC ..... 313/49; 362/219, 217.13, 217.01, 221, 362/225
See application file for complete search history.

(56) References Cited

U.S. PATENT DOCUMENTS 3,473,017 A 10/1969 Lim et al.
5,848,837 A * 12/1998 Gustafson ..... B64F 1/002 362/235

(Continued)

FOREIGN PATENT DOCUMENTS

DE 7522691 U 12/1975
EP 828114 A2 8/1998

(Continued)

OTHER PUBLICATIONS

"Ledline Concept 7 Longitudinal M Interconnection" Arthur Van Es, HTC7 2B.17, Nov. 28, 2011, pp. 1-5.

*Primary Examiner* — Vip Patel

(57) ABSTRACT

LED luminaire (10, 100, 200) for line illumination comprising an elongate trunk (12, 120, 220) having a first end portion (13, 121) and an opposite second end portion (15, 122), an elongate lighting carrier (14, 140, 240) comprising at least one LED based light source to form a continuous line of light, a first coupling member (142*a*, 142*b*) for detachably fastening the lighting carrier (14, 140, 240) to the trunk (12, 120, 220), and a second coupling member (134, 234) arranged for longitudinally connecting the trunk (12, 120, 220) in line with an adjacent trunk (12, 120, 220) of an adjacent LED luminaire (10, 100, 200) thereby forming a self-sustained trunking system. Detaching of the lighting carrier (14, 140, 240) is allowed in substantially a transverse direction with reference to the line of trunks (12, 120, 220), and without dismounting the trunk (12, 120, 220) from the trunking system.

13 Claims, 4 Drawing Sheets

(51) Int. Cl.
*F21S 4/00* (2016.01)
*F21S 8/04* (2006.01)

(56) References Cited

U.S. PATENT DOCUMENTS

| | | | | |
|---|---|---|---|---|
| 6,231,209 | B1 | 5/2001 | Leibig et al. | |
| 6,582,103 | B1 * | 6/2003 | Popovich | F21S 4/008 361/224 |
| 2003/0223232 | A1 * | 12/2003 | Belfer | F21V 19/0085 362/219 |
| 2006/0049368 | A1 | 3/2006 | Culbert | |
| 2010/0124053 | A1 | 5/2010 | Wu et al. | |
| 2011/0299512 | A1 | 12/2011 | Fukuda | |

FOREIGN PATENT DOCUMENTS

| | | | |
|---|---|---|---|
| EP | 870981 | A1 | 10/1998 |
| EP | 826920 | B1 | 8/2006 |
| EP | 870980 | A1 | 8/2006 |
| JP | 2010003683 | A | 1/2010 |
| WO | 0025063 | A2 | 5/2000 |
| WO | WO2011033430 | A1 | 3/2011 |

* cited by examiner

LED BASED LINE ILLUMINATION LUMINAIRE AND SYSTEM

CROSS-REFERENCE TO PRIOR APPLICATIONS

This application is the U.S. National Phase application under 35 U.S.C. §371 of International Application No. PCT/IB13/058416, filed on Sep. 10, 2013, which claims the benefit of U.S. Provisional Patent Application No. 61/704,091, filed on Sep. 21, 2012. These applications are hereby incorporated by reference herein.

TECHNICAL FIELD

The present invention relates to the field of line illumination luminaires and systems, and more particularly to LED based line illumination luminaires and systems.

BACKGROUND OF THE INVENTION

In line illumination systems a large number of luminaires are typically arranged in a row in one longitudinal direction. Traditional TL-lighting systems (tubular fluorescent lamp systems) make use of a trunking system to attach the TL-luminaires. These systems can be ceiling mounted or suspended from the ceiling using wires. The trunking system typically contains cabling. A known TL-luminaire suitable for line illumination is shown in EP 0828 114 A2, which discloses a luminaire for line illumination having a light carrier arranged with means projecting downwards from the light carrier having two connectors for electrically and mechanically engaging a TL-lamp on opposite sides thereof, a trunk shaped carrier to which the light carrier is mounted, and a reflector for beaming the light generated by the TL-lamp. The reflector is attached to the light carrier, and is further arranged having a coupling member projecting into a reflector of an adjacent luminaire when mounted in a line illumination system, to nest adjacent reflectors together. Assembly of such a known line illumination system requires a large number of mounting steps, and further requires several steps to access the light carrier.

Further, as LED based lighting devices, or LED lamps, have become common on the market, and are showing great promise to gradually replace incandescent and compact fluorescent lamps throughout the world due to long life-time expectancy, reduced size and weight, and high energy-efficiency with respect to energy and lumen output efficiency as compared to for instance traditional TL-tube lighting, it is desirable to provide LED based line illumination systems. Retrofit LED TL-lamps are available on the market today, which are applicable in existing TL-luminaire line illumination systems. However, replacing the TL-lamp with a retrofit LED TL-lamp in the known TL-luminaire above does not overcome the draw backs as described above.

SUMMARY OF THE INVENTION

In view of the above, it is an object of the invention to provide an alternative and improved luminaire for line illumination which is LED based, and which at least alleviates the problems above. The present inventive concept is based on providing a luminaire which comprises a trunking part and a detachable luminary part, which trunking part is mechanically connectable in a longitudinal direction with adjacent luminaires, while the luminary part can be dismounted in a transverse direction with reference to the line of trunking parts.

This object is achieved by a LED luminaire according to the present invention as defined in claim 1. Thus, in accordance with an aspect of the present invention, there is provided a LED luminaire for line illumination comprising an elongate trunk having a first end portion and an opposite second end portion, an elongate lighting carrier comprising at least one LED based light source arranged to form a continues line of light, a first coupling member for detachably fastening the lighting carrier to the trunk, and a second coupling member arranged for longitudinally connecting the trunk in line with an adjacent trunk of an adjacent LED luminaire thereby forming a self-sustained trunking system. Detaching of the lighting carrier is allowed in substantially a transverse direction with reference to the line of trunks, and without dismounting the trunk from the trunking system.

The LED luminaire according to the present invention is thus divided in a trunking part: the trunk, which typically comprises cables and a driver to control the light source, and a luminary part: the lighting carrier, which typically comprises a sheet metal carrier, the LED light source arranged on a PCB, and optics. The LEDs of the LED based source are preferably arranged such that the line of light in a line illumination system, formed by at least two adjacent LED luminaires when connected, is continuous. Thus, contrary to the known TL based line illumination system, the line of light sources in the present line illumination system does not suffer from discontinuities in the line of light due to the TL tube connections means. Further, the longitudinal second coupling means of the present LED luminaire is arranged to provide a mechanically free standing trunking system when the luminaire is connected to adjacent luminaires to form a line illumination. Thus, there is no need to provide a separate trunking system when mounting the luminaires. The trunk of each luminaire is mechanically coupled to adjacent trunks, thereby forming a trunking system which expands as each LED luminaire is mounted to the line illumination. The second coupling means are selected to form mechanically stable connections between each trunk, such that a stiff interconnection is achieved to avoid misalignment of the adjacent trunking modules, so-called snaking, when suspending the line illumination in wires. For replacement of one module, LED luminaire, in such a line illumination system, only the lighting carrier of that module needs to be replaced, while the trunk stays in place without breaking up the trunking system (although the second coupling means may be arranged such that the trunks may be disconnected).

According to embodiments of the LED luminaire, the second coupling member is arranged to connect the first end portion of the trunk to the second end portion of the adjacent trunk, which is advantageous for forming a line illumination system. The second coupling member engages with for instance a corresponding slot or corresponding coupling member arranged in each side wall of the trunk, to provide stability and aligning features.

According to embodiments of the LED luminaire, the second coupling member is arranged to at least partly overlap the second end portion of the adjacent trunk when connecting the trunk to the adjacent trunk, which may be utilized to increase the stiffness of the mechanical connection. As the second coupling member overlaps the adjacent trunk when mounted, it protrudes from the first end portion of the LED luminaire and may be used as a guiding portion during mounting.

According to embodiments of the LED luminaire, the second coupling member comprises at least two separate portions for engaging with an adjacent trunk. Thus, even though the second coupling member in embodiments of the LED luminaire may be arranged as a single piece, interconnection between the adjacent trunks with for instance two plates advantageously provides a cheap solution to form a stiff interconnection.

According to embodiments of the LED luminaire, the second coupling member is arranged to at least partly overlap the first end portion of the trunk.

According to embodiments of the LED luminaire, at least two separate portions of the second coupling member are arranged having different lengths of overlap with respect to the adjacent trunk, which facilitates mounting of the LED luminaire as the longer portion may act as a guiding portion during mounting.

According to embodiments of the LED luminaire, the second coupling member comprises at least one locking mechanism for engaging with a corresponding locking member of the first end portion of the trunk, and/or the second end portion of the adjacent trunk.

The second coupling element may be a separate part, which may optionally be pre mounted at the first end of the carrier during manufacture. Optionally, the second coupling element is an integral part of the trunk.

According to embodiments of the LED luminaire, the second coupling member comprises a sheet strip. Preferably, the sheet strip is made of sheet metal made of Steel or some other suitable metal. However, other materials, like for instance plastics, are applicable for the inventive concept. A thin sheet strip has the advantage of being more or less flexible in one direction along its longitudinal extension (horizontally), while being substantially stiff in a transverse direction (vertically) with respect to its longitudinal extension. Further, selecting a material of the second coupling member, e.g. when being a sheet strip or some other elongate protrusion for connecting to the adjacent trunk, to provide a flexible (resilient) second coupling member, advantageously facilitates mounting of the line illumination. For instance, when the second coupling member consists of two sheet metal strips arranged at the first end of, and on a respective side wall of the trunk, and the sheet metal strips are to be inserted in receiving cavities in the second end of the adjacent LED luminaire, the installer may slightly bend the sheet metal strips during mounting. Further, when arranging one of the sheet metal strips (or other applicable elongate protrusion) to be longer than the other, the longer sheet metal strip is advantageously fitted into its cavity first, and will then act as a guide when inserting the shorter sheet metal strip. Further, utilizing sheet strips as the second coupling member is advantageous because of low cost, low material usage, an uncomplicated manufacturing of the second coupling member etc. Once fixed in the end position, either by click fit or screws, the second coupling member assures a stiff form-fit connection, comparable with the trunk itself.

According to embodiments of the LED luminaire, the trunk comprises an opening arranged for receiving at least a portion of the coupling member or a coupling member of an adjacent LED luminaire.

According to embodiments of the LED luminaire, the opening is formed by a flanged side wall portion extending in a longitudinal direction, which flanged side wall portion is arranged to receive at least a portion of the coupling member. The trunk is in a preferred embodiment a folded metal sheet, which is advantageous because of low material usage, low weight, low cost, ease of manufacturing etc. Flanged side wall portions extending along the trunk, can then in a cheap and simple manufacturing step advantageously provide openings to receive a second coupling member on either end (first or second end portion) of the trunk. Further, the folded structure is advantageous as the flanged side wall and the inserted second coupling member, being for instance a metal sheet strip, together provide a stiff mechanical connection.

According to embodiments of the LED luminaire, the first coupling means is a snap fit connection, which is advantageous to provide simple mounting and dismounting of the lighting carrier.

According to a second aspect of the invention, there is provided a LED luminaire line illumination comprising at least two LED luminaires according to the present inventive concept, which has the advantages as described above.

The term LED-based light source includes any light source comprising electroluminescent light generating systems, thus including various semiconductor-based structures that emit light in response to current, light emitting polymers, organic light emitting diodes (OLEDs), electroluminescent strips, etc. Further, a LED-based light source includes LED dies, LED chips, and LED packages. Other objectives, features and advantages will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1A:
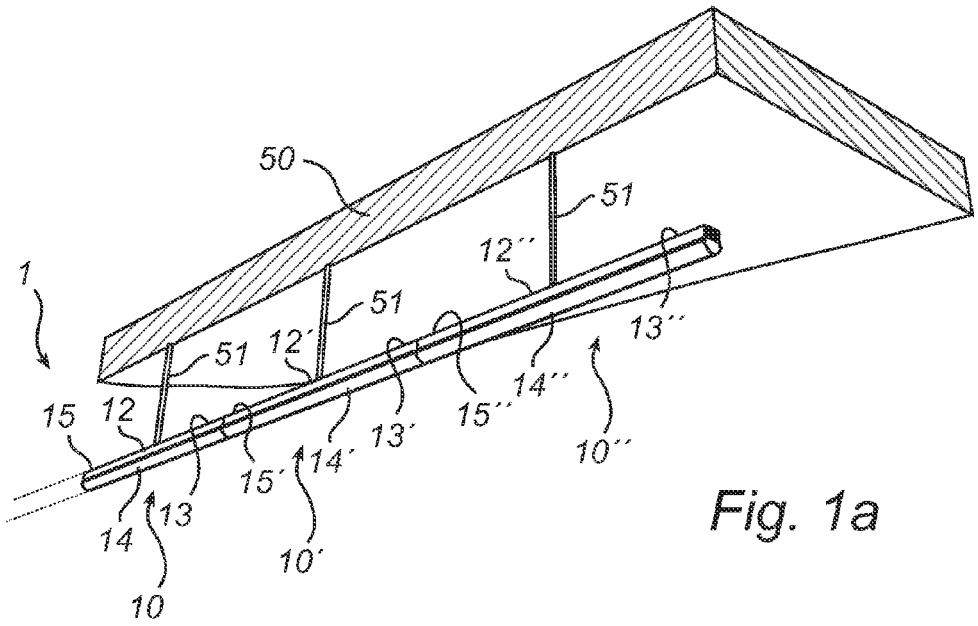
FIG. 1*a*) is a perspective view illustration of a LED line illumination system according to the present inventive concept, 1 *b*) to *e*) show an embodiment of a LED luminaire according to the present inventive concept in a perspective side view and perspective close up views to illustrate details of the LED luminaire, and FIGS. 2*a*)-*d*) show an embodiment of a LED luminaire according to the present inventive concept in perspective close up views and a cut through view to illustrate details of the LED luminaire.

An exemplifying embodiment of a LED line illumination system and LED luminaires suitable for such a system according to the present inventive concept is now described with reference to FIG. 1. A LED line illumination system 1 according to an embodiment of the present inventive concept is illustrated in FIG. 1*a*), in which a plurality of LED luminaires, . . . , 10, 10', 10", according to the present inventive concept are longitudinally interconnected and suspended in chains 51 which are attached to a ceiling 50. Each LED luminaire 10, comprises an elongate trunk 12, having a first end portion 13, an opposite second end portion 15, and an elongate lighting carrier 14 which is detachably attached to the trunk 12. The first end portion 13 of trunk 12 of the LED luminaire 10 is interconnected with the second end portion 15' of the adjacent LED luminaire 10' and so forth. Ceiling mounted solution is also applicable for this LED line illumination system.

Figure 1B:
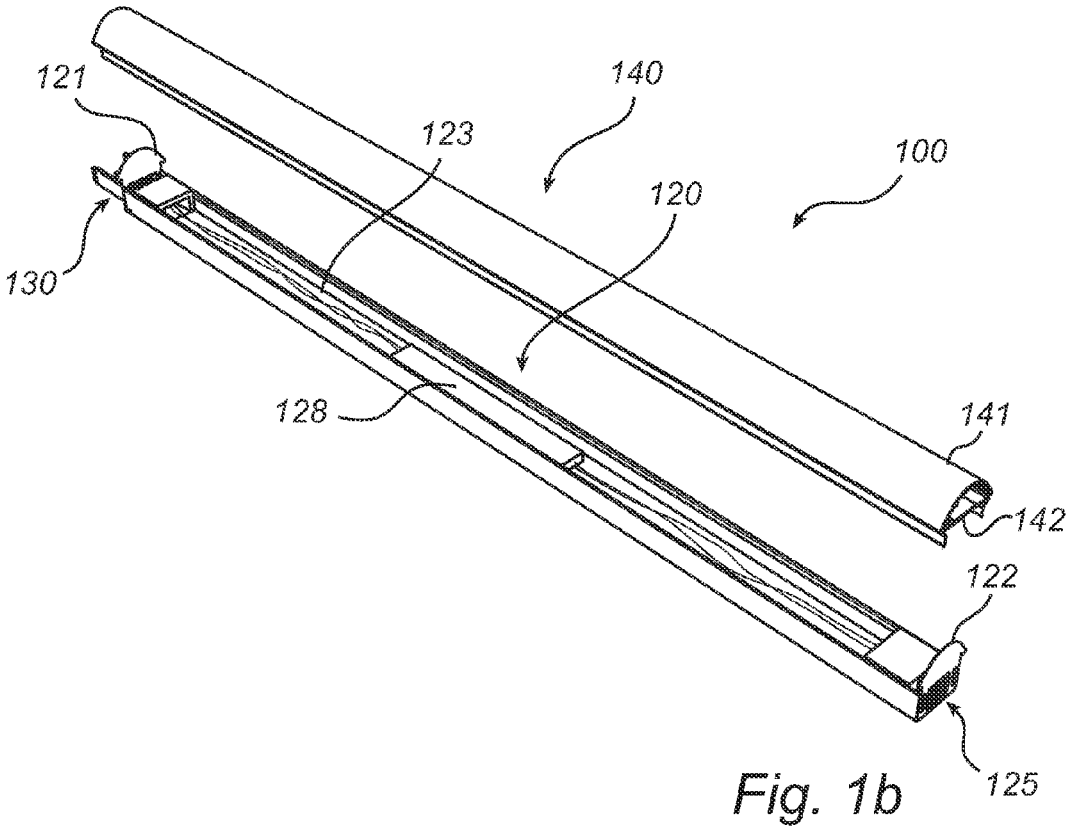
Figure 1C:
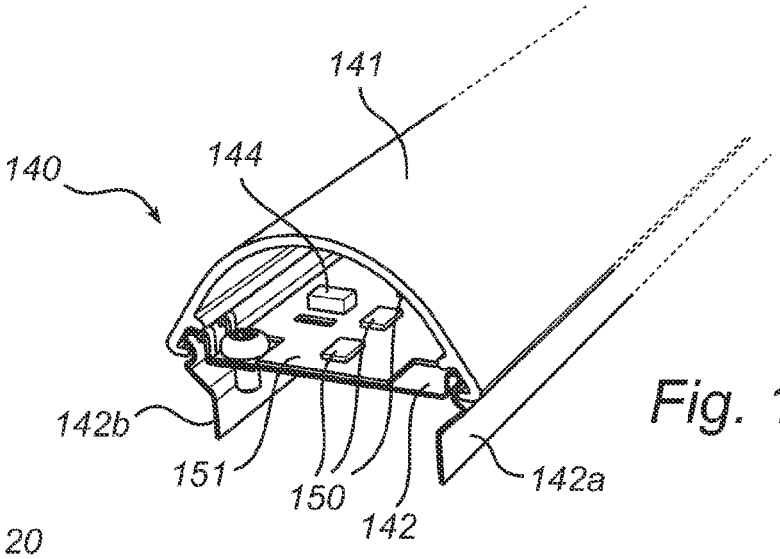

An exemplifying embodiment of a LED luminaire 100 according to the present invention and which is suitable for a LED line illumination system as described above is illustrated in a partly exploded view in FIG. 1*b*). A trunk 120 comprises an elongate sheet metal body which is folded to form a housing 123 for cables and a light source driver 128. At each end portion: a first end portion 121, and an opposite second end portion 122 of the housing 123, a respective connector: a first connector 130 and a second connector 125, is arranged for mechanical and electrical interconnection with adjacent LED luminaires. The LED luminaire 100 further comprises a luminary part: a lighting carrier 140, which here comprises a sheet metal carrier 142, and optics: here a lens 141. Referring now to FIG. 1*c*) which is a close up of the lighting carrier 140, the lighting carrier 140 is further provided with LED based light sources 150 arranged on a PCB 151. The lens 141 is attached to the sheet metal carrier to control the light from the LED based light sources 150 and to cover the PCB 151 and the LED based light sources 150. The sheet metal carrier 142 provides a mounting surface and a cooling surface for the PCB 151. Flanged edges, 142*a*, and 142*b*, of the sheet metal carrier 142 extending along the longitudinal extension the sheet metal carrier 142 are arranged to provide a first coupling member for detachably fastening the lighting carrier 140 to the trunk 120.

Figure 1D:
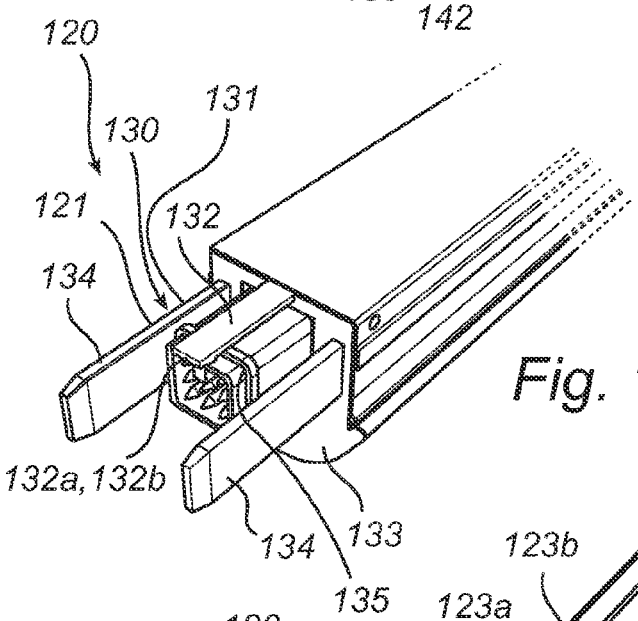

The LED luminaire 100, in specific the trunk 120 is illustrated in more detail in FIGS. 1*d*) and 1*e*). FIG. 1*d*) is a close up of the first end portion 121, at which the first connector 130 is arranged. The first connector 130 comprises an electrical connector, which here is male connector 130. The first connector 130 further comprises a second coupling means for connecting the LED luminaire 100 to an adjacent LED luminaire. The second coupling means here comprises two protrusions 134 extending from the connector 130 and the housing, the sheet metal carrier 142, in a longitudinal direction. The second coupling means further comprises a locking element 132, which here is a resilient tongue extending from the connector 130 (or the optionally the housing) in a longitudinal direction, which at an outer front edge 132*a* is provided with a protrusion 132*b* arranged to be received in a corresponding receiving portion of an adjacent trunk, which will be described below.

Figure 1E:
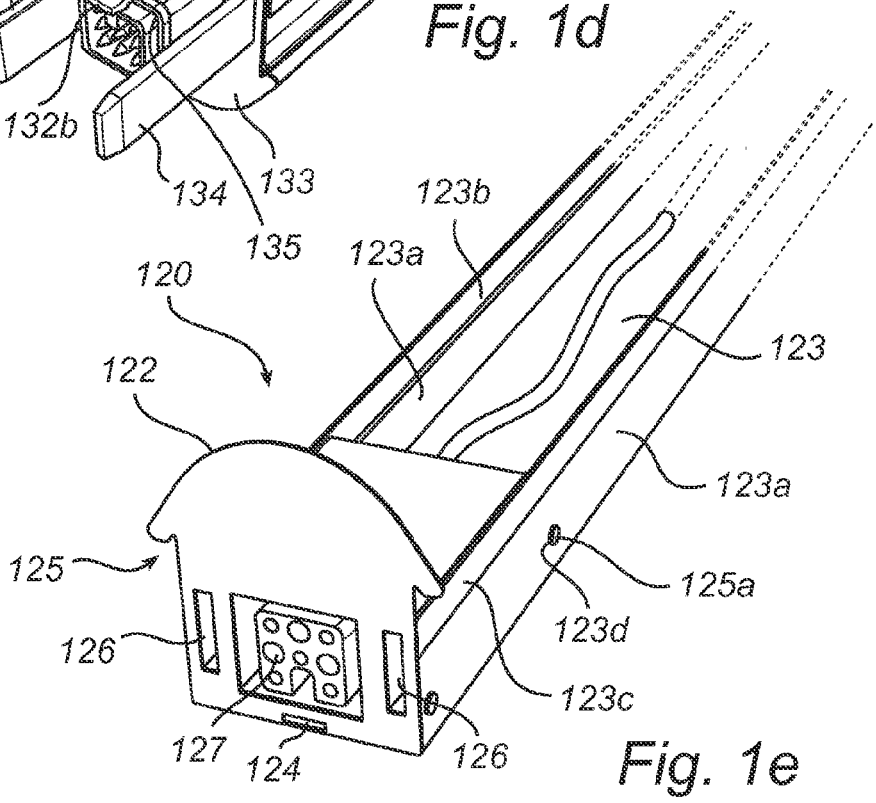
Figure 2A:
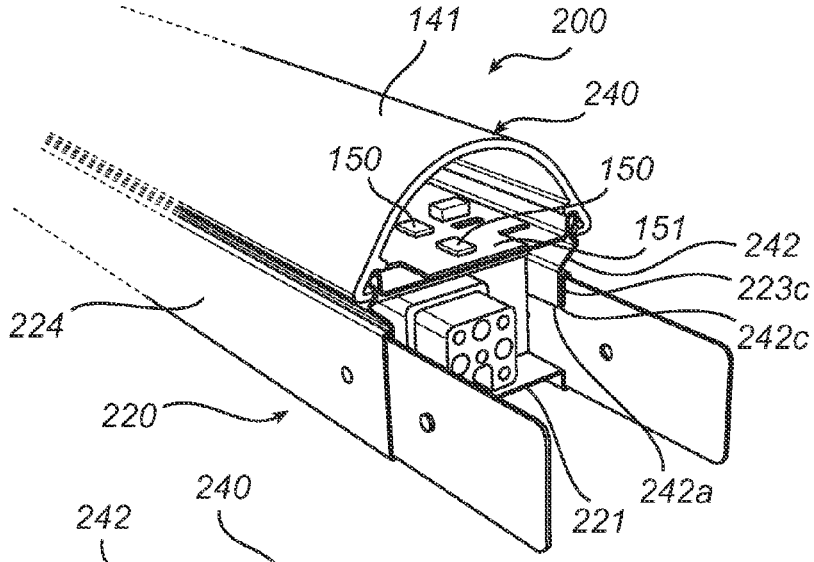
Figure 2B:
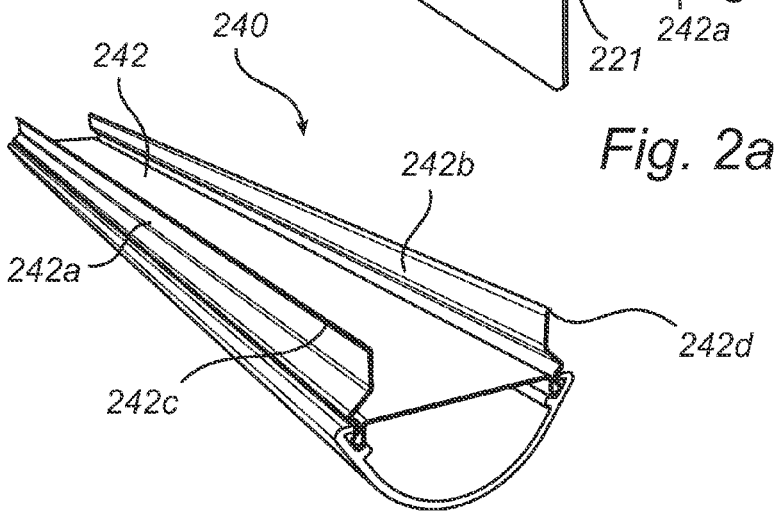

FIG. 1*e*) is a close up of the second end portion 122 of the trunk 120, at which second end portion 122 the second connector 125 is arranged. The second connector 125 comprises an electrical connector, which here is female electrical connector 127 adapted to receive the male connector 130 of an adjacent LED luminaire. The second connector 125 further comprises a receiving coupling means for connecting to an adjacent LED luminaire, which here comprises two recesses 126 adapted to receive two protrusions extending from the first end portion of a trunk of an adjacent LED luminaire (corresponding to the protrusions 134 as described above). The receiving coupling means further comprises a receiving recess 124 adapted to receive and secure a locking element of a second coupling means of a trunk of an adjacent LED luminaire (corresponding to the locking element 132 as described above which together with the receiving recess 124 form a snap lock). The housing 123 of the trunk 120 is provided with flanged edges 123*a*, which extend longitudinally along the trunk 120. The flanged edges are provided with openings 123*d* arranged to receive protrusions 125*a* of the second connector 125 for fastening of the connector 125 in the trunk 120. The first connector 130 is fastened to the housing 123 in a similar manner. Other fastening means to secure the first and second connectors to the housing are applicable, e.g. screws. The flanged edges, 123*a* and 123*b*, are further provided with a respective step shaped formation 123*c* and 123*d* along the rim, which together with the first and second connectors form a receiving track for the first coupling members, flanges 142*a* and 142*b*, of the lighting carrier 140 for detachably fastening the lighting carrier 140 to the trunk 120. Alternatively, the first coupling means is arranged as protrusions and openings or receiving domes that snap fit. Alternatively, the first coupling means is provided similar to the bended edge 242*c* in FIG. 2*b*) or is even provided by means of screws, which is advantageous to provide an earthquake proof solution. The housing and carrier, is preferably made of sheet metal or aluminum but even plastic pultrusions are applicable.

To continue, when the second coupling member of the LED luminaire 100 is engaged with the receiving coupling member of an adjacent LED luminaire, the longitudinally interconnection of the trunk 120 in line with the adjacent trunk of an adjacent LED luminaire forms an interconnected trunking system. Detaching of the lighting carrier 140 of either the LED luminaire 100 or the adjacent LED luminaire is allowed in substantially a transverse direction with reference to the line of trunks, and without dismounting the trunk 120 or the adjacent trunk from the trunking system.

According to a preferred embodiment of the LED luminaire 200, which is illustrated in FIG. 2 and which has a similar basic structure as described for the LED luminaire 100 above, i.e. the LED luminaire 200 comprises a luminary part and a trunking part and are longitudinally interconnectable with adjacent LED luminaires to form a line illumination system according to the present inventive concept. The luminary part is a lighting carrier 240 which comprises a folded sheet metal carrier 242, LED based light sources 150 arranged on a PCB 151, and optics, a lens 141 which is attached to the sheet metal carrier covering the PCB 151 and the LED based light sources 150.

The trunking part is here a trunk 220, to which the lighting carrier 240 is detachably fastened. In this exemplifying embodiment, the lighting carrier 240 is attached to the trunk 220 by means of resilient flanged edge portions, 242*a* and 242*b*, extending along the sheet metal carrier 242 which are provided with a respective bended edge 242*c*, 242*d* at the outer rim thereof, see FIG. 2*b*). When assembling the lighting carrier 240 and the trunk 220, the edge portions of the sheet metal carrier 242, 242*a* and 242*b*, are pressed together inwardly towards a longitudinal centre of the sheet metal carrier 242, and inserted in the trunk 220, which contains corresponding receiving portions 223*c* (see close up of the trunk 220 in FIG. 2*c*)) to secure the bended edges 242*c*, 242*d* as the resilient flanged edge portions relax back towards their initial state. It should be mentioned that other means for detachably fastening the lighting carrier 240 to the trunk 220, like protrusions and openings or domes (protrusions) that snap fit, or screws, are applicable.

Figure 2C:
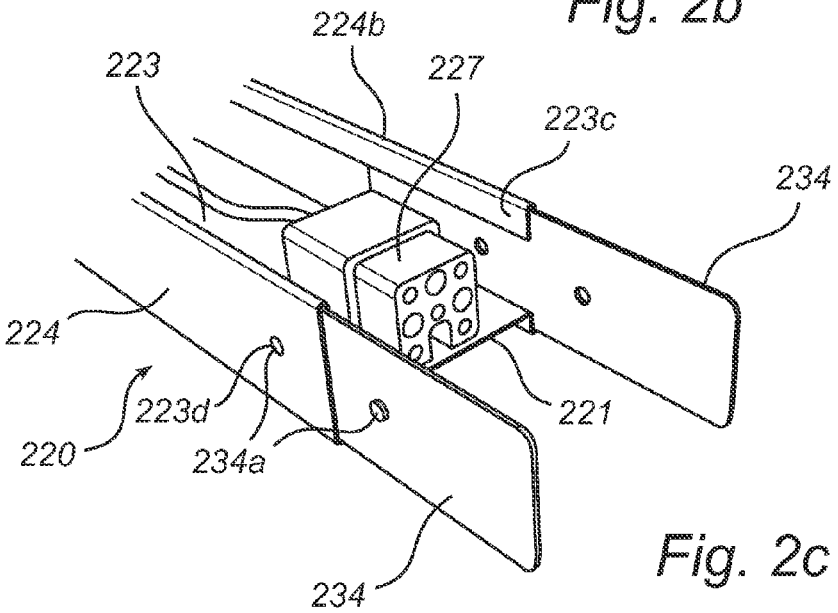
Figure 2D:
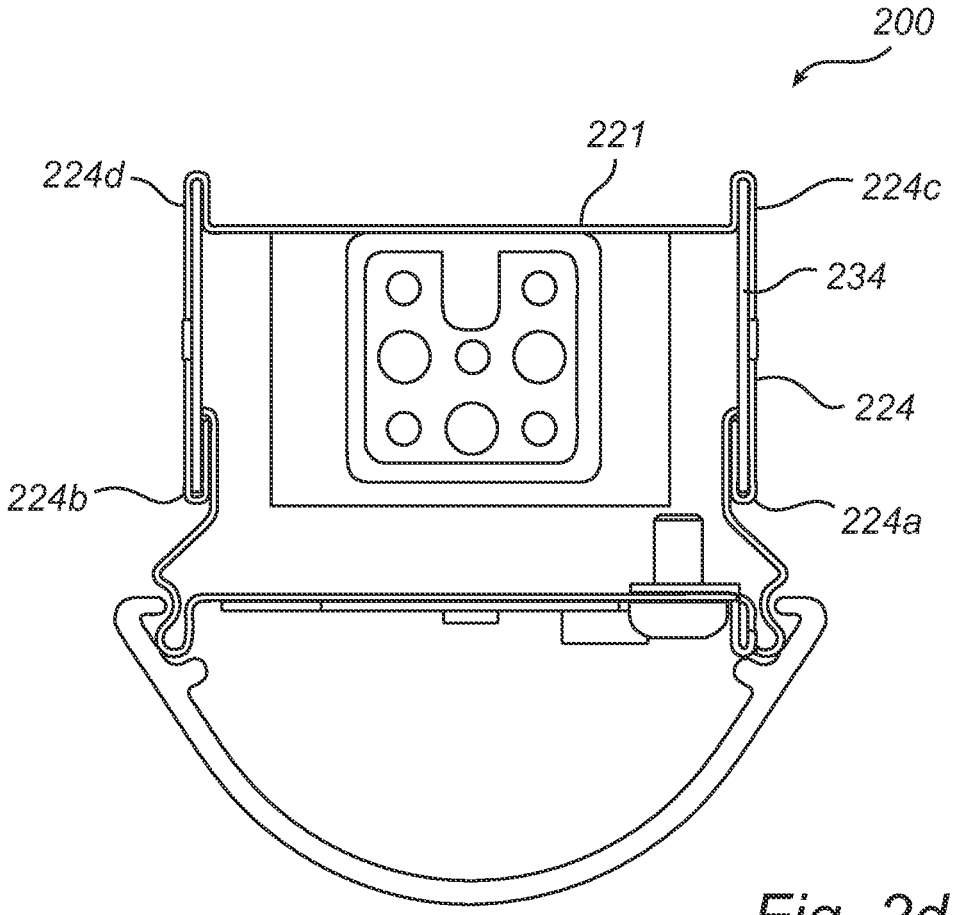

To continue, referring to FIG. 2*c*), the trunk 220 comprises an elongate sheet metal body which is folded to form a housing 223, with a bottom portion 221, and two side walls 224, arranged for containing cables and a light source driver (not shown). At each end portion of the housing 223, a respective connector for electrical interconnection, one male electrical connector (not shown) and a female electrical connector 227, as illustrated in FIG. 2*c*), is arranged for electrical interconnection with an adjacent LED luminaire. Further, in this exemplifying embodiment, the walls 224 of the housing 223 are arranged with flanged side wall portions 224*a*, 224*b* (see also cross sectional view in FIG. 2*d*)) extending longitudinally along an upper end of the side walls 224 of the housing 223. The flanged side wall portions 224*a*, and 224*b*, act as receiving portions 223*c*, and more particularly engaging areas for the gripping hook 242*c* of the flanged side wall portions 242*a* and 242*b*, for the first coupling means for detachably fastening the lighting carrier 240 to the trunk 220.

Further, the flanged side wall portions 224*a* and 224*b* form receiving cavities adapted to receive second coupling means. At both end portions of the housing 223 of the trunk 220, second coupling means in the form of sheet strips 234, made of metal or any other applicable material, can be inserted in the receiving cavity which is formed by the flanged/folded side wall portions 224*a*, 224*b*. For an improved fitting of the sheet strips, the side walls 224 are further provided with double folding lines: a first folding line as described above formed by the flanged side wall portions 224*a* and 224*b*, and further a second folding line arranged at the bottom portion 221 of the housing, which second folding line here corresponds to folding 224*c* and 224*d* at the respective side wall 224, see FIG. 2*d*). It should be noted that other shapes of the folding to form receiving cavities and other shapes of the second coupling means are applicable for the present inventive concept, although only the sheet strip solution is shown here. Further, two strips can even be integrated to one second coupling means. To continue, the second coupling means may further comprise a locking element, which here are protrusions 234*a* arranged in the side wall of the sheet strip 234, which when the sheet strip 234 is inserted in the receiving portion, i.e. folded side wall portion 224 of the trunk 220 (or in a folded side wall portions of an adjacent trunk), is received in a corresponding opening 223*d* arranged in that side wall 224, thereby (detachably) fastening the sheet strip 234 in a mounted position.

The housing 223 is preferably symmetrical in that the flanged side walls 224 extend along the whole length of the housing. Further, when containing locking element members, like the openings 223*d*, associated with a locking element of the second coupling means, here protrusions 234*a* in the sheet strips 234, these are arranged symmetrically on the side walls thereof. In an alternative embodiment the sheet strip is, at the first end portion of the housing, integrated with the housing, thereby eliminating loose parts other than the luminary part and the trunking part.

When mounted in position at the first end portion of the housing 223 (or when being integrated in the housing), the sheet strips 234 extend from the first end portion of the trunk 220 in a longitudinal direction for ease of assembly for instance in that one protrusion or sheet strip 234 connects to the adjacent luminaire to pre-align the trunks with respect to each other before the second protrusion or sheet strip 234 connects. The protrusions 134 or sheet strips 234 can have chamfered edges for guidance into receiving holes 126 or portions 224 of a trunk 220. In embodiments of the LED luminaire, the sheet strips have different length of overlap with respect to the adjacent trunk/LED luminaire.

The invention has mainly been described above with reference to a few embodiments. However, as is readily appreciated by a person skilled in the art, other embodiments than the ones disclosed above are equally possible within the scope of the invention, as defined by the appended claims.

The invention claimed is:

1. A LED luminaire for line illumination comprising:

an elongate trunk having a first end portion and an opposite second end portion;

an elongate lighting carrier comprising at least one LED based light source to form a continuous line of light;

a first coupling member for detachably fastening said lighting carrier to said trunk;

a second coupling member arranged for longitudinally connecting said trunk in line with an adjacent trunk of an adjacent LED luminaire thereby forming a self-sustained trunking system; and a light source driver to control the at least one LED based light source, the elongate lighting carrier being detachably connectable to the light source driver;

wherein said second coupling member comprises at least two separate portions for engaging with a respective side wall of an adjacent trunk, wherein the light source driver is housed within the trunk to permit detachment of said lighting carrier from the light source driver and the elongate trunk in substantially a transverse direction with reference to the line of trunks, and without dismounting the trunk from said trunking system.

2. The LED luminaire according to claim 1, wherein said second coupling member is arranged to connect the first end portion of said trunk to the second end portion of said adjacent trunk.

3. The LED luminaire according to claim 1, wherein said second coupling member is arranged to at least partly overlap the second end portion of said adjacent trunk when said trunk is connected with said adjacent trunk.

4. The LED luminaire according to claim 3, wherein at least two separate portions of the second coupling member are arranged having different lengths of overlap with respect to the adjacent trunk.

5. The LED luminaire according to claim 1, wherein said second coupling member is arranged to at least partly overlap said first end portion of said trunk.

6. The LED luminaire according to claim 1, wherein said second coupling member comprises at least one locking mechanism for engaging with a corresponding locking member of said first end portion of said trunk, and/or said second end portion of said adjacent trunk.

7. The LED luminaire according to claim 1, wherein said second coupling member comprises a sheet strip.

8. The LED luminaire according to claim 1, wherein said trunk comprises an opening arranged for receiving at least a portion of said second coupling member or a coupling member of an adjacent LED luminaire.

9. The LED luminaire according to claim 8, wherein said opening is formed by a flanged side wall portion extending in a longitudinal direction.

10. The LED luminaire according to claim 1, wherein said first coupling member is a snap fit connection.

11. The LED luminaire line illumination comprising at least two LED luminaires according to claim 1.

12. A LED luminaire for line illumination comprising:

an elongate trunk having a first end portion and an opposite second end portion;

an elongate lighting carrier comprising at least one LED based light source to form a continuous line of light;

a first coupling member for detachably fastening said lighting carrier to said trunk, the first coupling member including two flanged edges that extend along a longitudinal axis of the elongate lighting carrier and snap fit into corresponding formations of the elongate trunk; and a second coupling member arranged for longitudinally connecting said trunk in line with an adjacent trunk of an adjacent LED luminaire thereby forming a self-sustained trunking system;

wherein operation of the first coupling member facilitates detachment of said lighting carrier in substantially a transverse direction with reference to the line of trunks, and without dismounting the trunk from said trunking system.

13. A LED luminaire for line illumination comprising:

an elongate trunk having a first end portion and an opposite second end portion;

an elongate lighting carrier comprising at least one LED based light source to form a continuous line of light;

a first coupling member for detachably fastening said lighting carrier to said trunk, the first coupling member including one or more flanged edges that snap fit into one or more corresponding formations of the elongate trunk;

a second coupling member arranged for longitudinally connecting said trunk in line with an adjacent trunk of an adjacent LED luminaire thereby forming a self-sustained trunking system; and a light source driver to control the at least one LED based light source, the elongate lighting carrier being detachably connectable to the light source driver;

wherein the light source driver is housed within the trunk to permit detachment of said lighting carrier from the light source driver and the elongate trunk in substantially a transverse direction with reference to the line of trunks, and without dismounting the trunk from said trunking system.

* * * * *